US006628192B2

(12) United States Patent
Steinbicker

(10) Patent No.: US 6,628,192 B2
(45) Date of Patent: Sep. 30, 2003

(54) CIRCUIT BREAKER FLOWER

(76) Inventor: Mark Werner Steinbicker, 3718 12th STSouth, Arlington, VA (US) 22204

( * ) Notice: Subject to any disclaimer, the term of this patent is extended or adjusted under 35 U.S.C. 154(b) by 40 days.

(21) Appl. No.: 09/974,278

(22) Filed: Oct. 11, 2001

(65) Prior Publication Data

US 2003/0071709 A1 Apr. 17, 2003

(51) Int. Cl.[7] ..... H01H 71/04; H01H 9/16; H01H 9/18

(52) U.S. Cl. ..... 337/79; 337/66; 337/332; 337/376; 200/308; 200/312; 116/279

(58) Field of Search ..... 337/66, 79, 244, 337/267, 332, 376; 200/56 R, 308–317; 116/277–281, 321–323

(56) References Cited

U.S. PATENT DOCUMENTS

| | | | | | |
|---|---|---|---|---|---|
| 1,281,285 | A | * | 10/1918 | Buchanan | 337/244 |
| 1,337,357 | A | * | 4/1920 | Holdorf | 337/244 |
| 1,645,344 | A | * | 10/1927 | O'Brien | 337/264 |
| 1,849,917 | A | * | 3/1932 | Feldmann | 337/267 |
| 2,052,267 | A | * | 8/1936 | Wilcox | 337/267 |
| 2,086,406 | A | * | 7/1937 | Dieffenbacher | 337/267 |
| 2,188,816 | A | * | 1/1940 | Rankin | 337/244 |
| 2,271,729 | A | * | 2/1942 | Baldwin et al. | 337/267 |
| 2,918,551 | A | * | 12/1959 | Kozacka | 337/244 |
| 3,622,932 | A | * | 11/1971 | Cunavelis et al. | 337/376 |
| 3,729,607 | A | * | 4/1973 | Ellenberger | 200/314 |
| 3,944,847 | A | * | 3/1976 | Kinnear | 307/131 |
| 4,156,225 | A | * | 5/1979 | Cuzzone | 337/244 |
| 4,342,979 | A | * | 8/1982 | Phillips | 337/41 |
| 4,427,963 | A | * | 1/1984 | Jarosz et al. | 337/6 |
| 4,635,021 | A | * | 1/1987 | Hsieh | 337/76 |
| 4,939,495 | A | * | 7/1990 | Peterson et al. | 337/79 |
| 5,264,818 | A | * | 11/1993 | Truchet et al. | 337/79 |
| 5,541,569 | A | * | 7/1996 | Jang | 337/68 |
| 5,633,618 | A | * | 5/1997 | Chuang | 337/56 |
| 5,886,613 | A | * | 3/1999 | Magoon et al. | 337/244 |
| 2002/0185052 | A1 | * | 12/2002 | Kelly et al. | 116/216 |

FOREIGN PATENT DOCUMENTS

| | | | | |
|---|---|---|---|---|
| DE | 3743482 A1 | * | 7/1989 | H01H/85/30 |

* cited by examiner

*Primary Examiner*—Anatoly Vortman

(57) ABSTRACT

A push-pull circuit breaker is provided primarily for use in aircraft; wherein, the activation of the circuit breaker is made significantly more noticeable by the addition of a "flower" device. Specifically, as the center post of the circuit breaker deploys, "petals" at the periphery of the post expand outward. The petal expansion greatly enhances the visibility and thereby recognition of said circuit breaker deployment by flight crew or maintenance personnel. This design capitalizes on the safety and reliability of existent circuit breaker designs. Finally, the flower design incorporates only one part interlocked with the circuit breaker post to achieve the stated purpose.

1 Claim, 5 Drawing Sheets

FLOWER TOP

FLOWER SIDE

PETAL DETAIL

POST

HOUSING

SECTIONS

I-I

II-II

III-III

IV-IV

CIRCUIT BREAKER FLOWER
OPEN

CIRCUIT BREAKER FLOWER

CROSS-REFERENCE TO RELATED APPLICATIONS

Not applicable.

STATEMENT REGARDING FEDERALLY SPONSORED RESEARCH OF DEVELOPMENT

Not applicable.

REFERENCE TO A MICROFICHE APPENDIX

Not Applicable.

BACKGROUND OF INVENTION

This invention relates to the field of aviation push-pull type circuit breakers which have an internal post that extends when the breaker is tripped. Further, said circuit breaker has flower "petals" that expand when the breaker is tripped to aid identification of said condition.

Current aviation push-pull type circuit breakers are designed to provide electro-thermal protection to various electrical devices in aircraft. In more advanced aircraft, a limited number of circuit breakers are monitored by a centralized fault warning computer. In most aircraft however, the only notification to the flight crew of a circuit breaker's activation would come in one or a combination of the following four modes.

First, the operational failure of the assigned component would be observed e.g., loss of power to a radio or indicator panel. Second, the crew might visually observe the circuit breaker in the "popped" condition as it would be higher than other circuit breakers surrounding it and would generally have a white collar around its "stem" to aid in identification. This identification can be difficult however, as many circuit breaker panels contain numerous circuit breakers; all of the same shape, size, and color. In addition, many of the panels are located in such a manner that they are viewed perpendicularly by the crew, making the vertical deployment of the breaker and its associated white ring difficult to observe. Third, the crew may hear an audible click of a circuit breaker as it trips. This method is often not practical due to the ambient noise in the flight deck. Finally, the crew may resort to a tactile examination of the panel. In many instances, a member of the crew will slide his or her hand over the surface of the panel to feel for any raised circuit breakers. This last method is especially common in low light conditions.

The use of an easily distinguishable indicator for an activated circuit breaker, as viewed from different angles and under varying light conditions, would greatly aid in identification of the particular malfunction. The circuit breaker flower allows for more accurate and quicker identification. As a result, this device would decrease the time required for troubleshooting and application of appropriate action. In addition, the circuit breaker flower modifies and enhances existing circuit breaker designs that have proved to be extremely reliable, durable, and safe.

A lighted aviation circuit breaker, U.S. Pat. No. 4,342,979 to Phillips, was developed to decrease the aforementioned identification problems. While the lighted design is advantageous in low light conditions, the design requires the functioning of too many elements and therefore has a greater probability of failure. Specifically, the internal bulb may fail negating the intent of the device. The lighted design also requires electrical power. In many cases, electrical power may not be available or desired during emergencies or aircraft maintenance status checks. The flower design may be observed in low ambient light conditions by the use of a flashlight, a required item by the Federal Aviation Administration for all flight crews operating at night.

Aviation circuit breakers are sometimes purposely opened for extended periods to deactivate a particular piece of equipment. The circuit breaker flower is compatible with the devices used to achieve this purpose. Additionally, aviation circuit breakers sometimes have "collars" installed around the top of the post to assist with their opening by providing a better grip. Once again, the circuit breaker flower is compatible with such devices and does not hinder their operation.

BRIEF SUMMARY OF INVENTION

In accordance with this invention, an aviation push-pull type circuit breaker is provided for use in aircraft so that the activation or tripping of said circuit breaker would be more readily apparent to flight crew or maintenance personnel. Specifically, this circuit breaker modification is designed so that as the center post of the circuit breaker extends, a ring surrounding the post also extends, allowing "petals" at the top of said ring to expand outward.

Further, the petals are forced outward by the normal action of the post extending because the ring and petal arrangement is installed on the post via grooves and retaining blocks. This action of the petals expanding resembles the opening of a flower, hence the name "circuit breaker flower." The post is retracted manually i.e., "pushed in", and the ring and petal arrangement retract as well because of an interlocking relationship between the ring and post.

BRIEF DESCRIPTION OF THE SEVERAL VIEWS OF THE DRAWING (All measurements are included to indicate the relative size of the components with respect to each other. These measurements may be adjusted to accommodate various sizes of circuit breakers.)

DETAILED DESCRIPTION OF THE INVENTION

Best Mode for Carrying out the Invention

Figure 1:
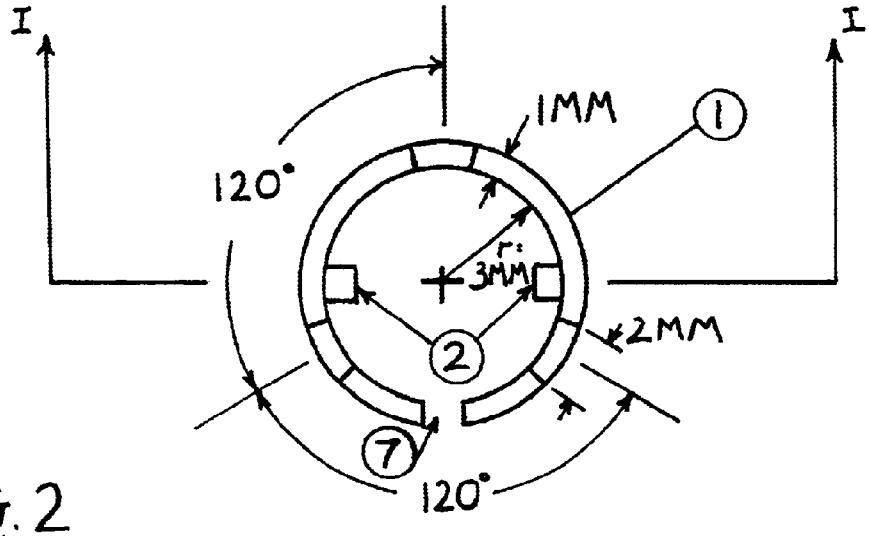
FIG. 1 is a view from above the ring and petal device showing the radial relationship of the petals and the retaining blocks.
Figure 2:
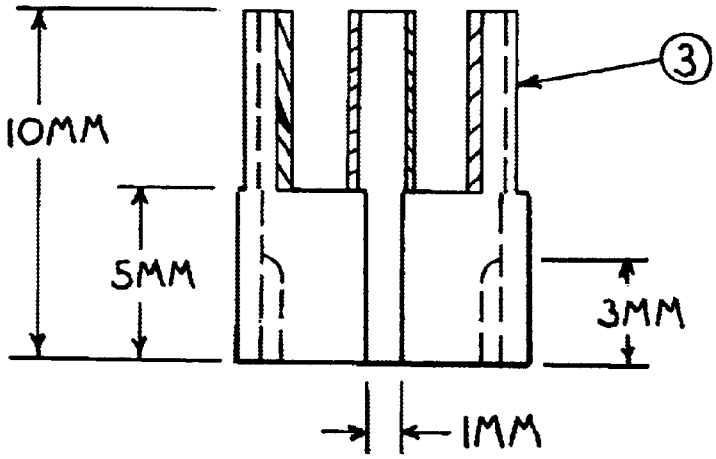
FIG. 2 is a side view of the ring and petal device showing the longitudinal size of the ring and petals relative to each other.
Figure 3:
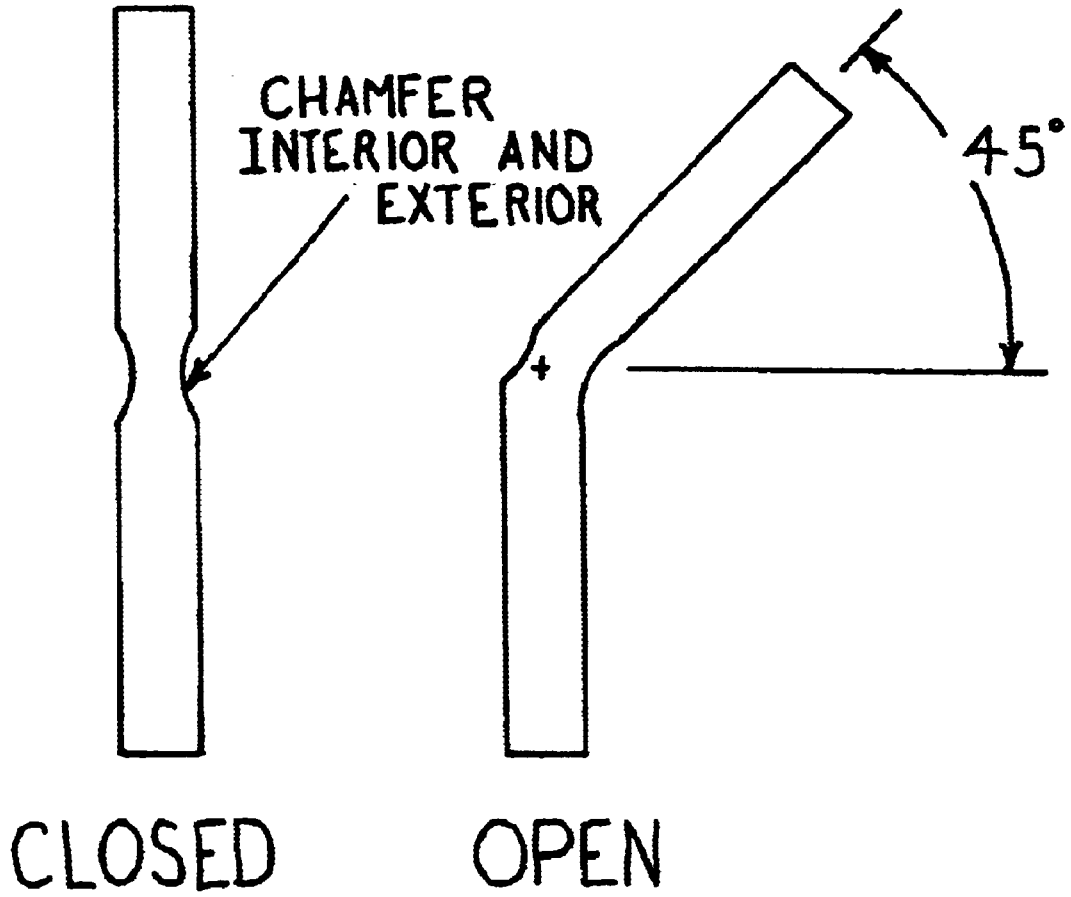
FIG. 3 is an expanded view of the petal design.

A flower device, as indicated in FIG. 1 and FIG. 2, is formed through the use of injection molding for plastic material or stamping/bending for metal. Specifically, the flower device incorporates a base ring (1), retaining blocks (2), and petals (3). The base ring's interior diameter is slightly larger than the post's exterior diameter and includes an expansion gap (7) to allow for installation and potential removal. The petal design includes interior and exterior rounded edges at rub points, see FIG. 3, to reduce wear and material stress.

Figure 4:
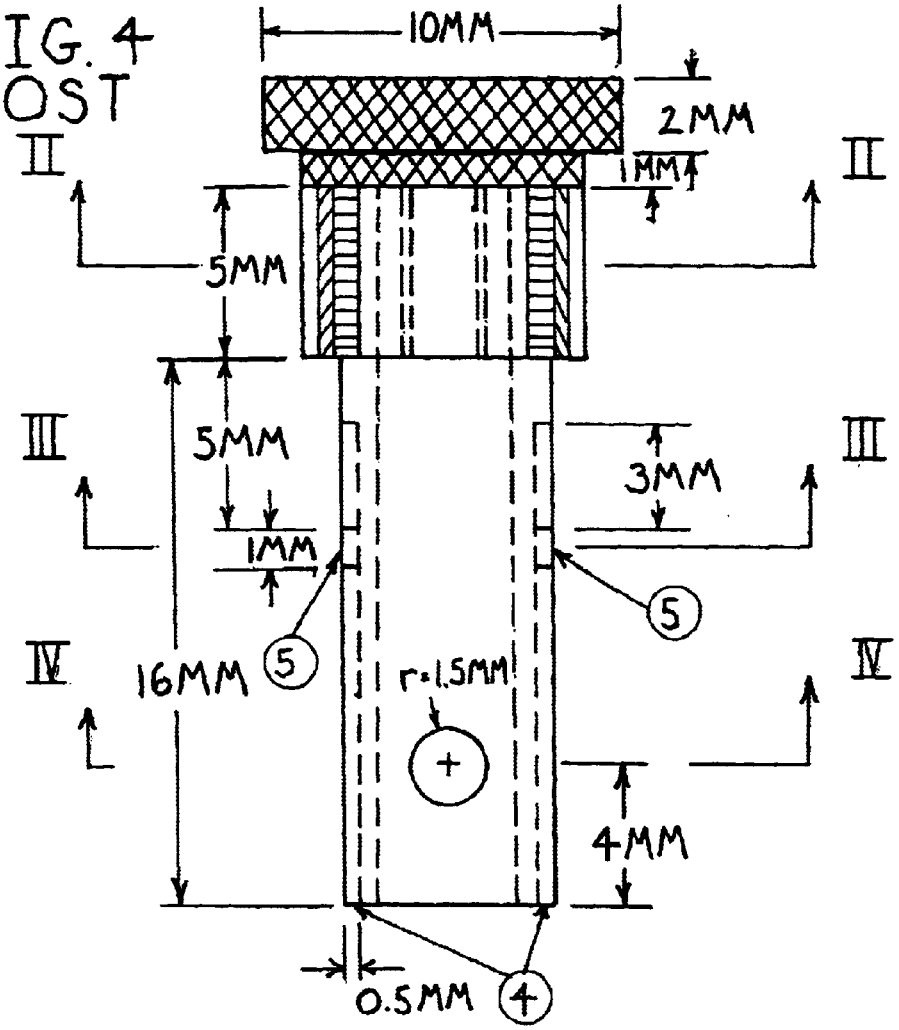
FIG. 4 is a side view of a typical push-pull circuit breaker post modified to accept the circuit breaker flower.
Figure 5:
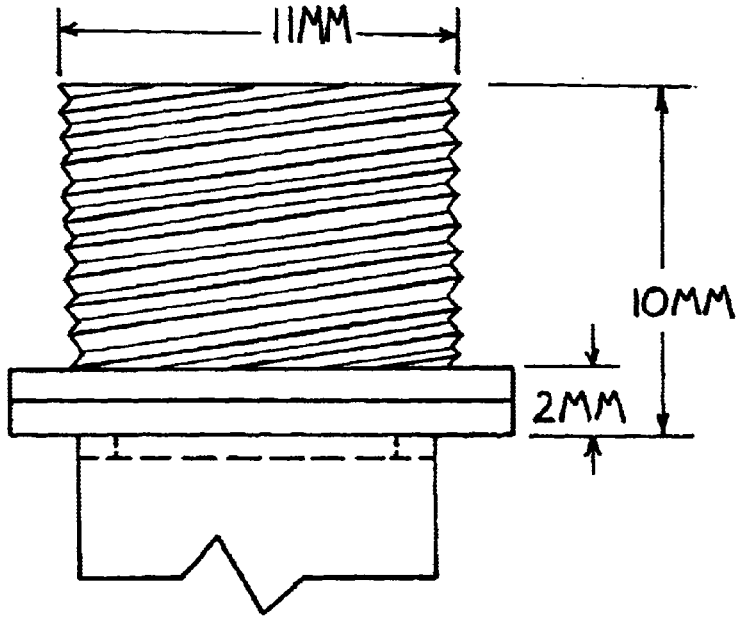
FIG. 5 is a side view of a typical push-pull circuit breaker housing.
Figure 6:
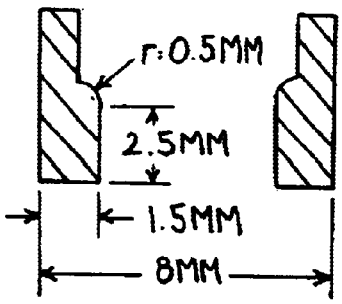
FIG. 6 is a section view of the ring part of the circuit breaker flower.
Figure 7:
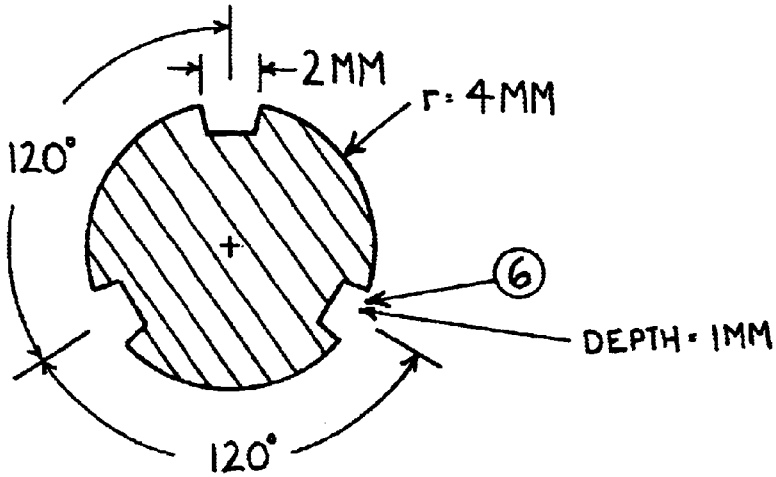
FIG. 7 is a section view of the top of the typical circuit breaker post showing the grooves designed to accommodate the petals of the circuit breaker flower.
Figure 8:
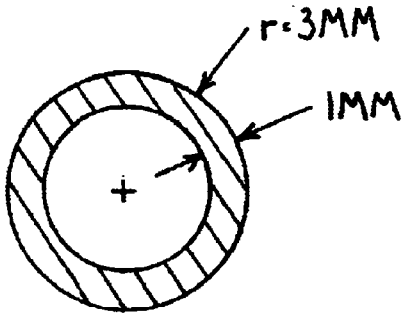
FIG. 8 is a section view of the typical circuit breaker post at the level of the post retaining blocks.
Figure 9:
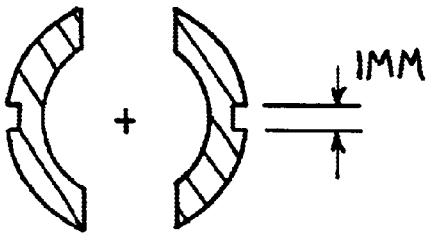
FIG. 9 is a section view of the typical circuit breaker post below the level of the post retaining blocks showing the grooves designed to accommodate the retaining blocks on the ring of the circuit breaker flower.
Figure 10:
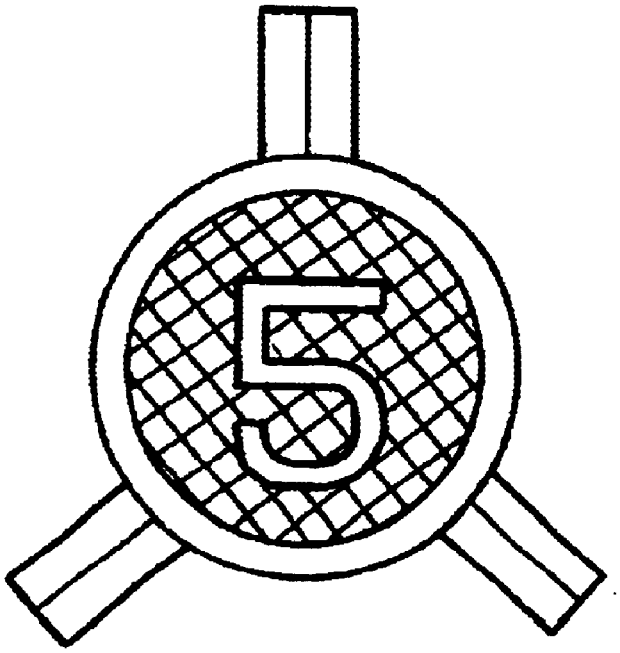
FIG. 10 is a top view of the open circuit breaker flower.

In addition, a circuit breaker post, as indicated in FIG. 4, is manufactured to accommodate the flower device. Specifically, the post incorporates two channels (4) and retaining blocks (5) which allow the base ring to slide and lock onto the post. The flower retaining blocks are rounded on one end to aid with installation onto the post. Conversely, the flower retaining blocks are square at the other end to resist inadvertent removal. Additionally, as seen in FIG. 7, the post design includes additional channels (6) which accommodate the petals as the post mechanism retracts into the housing.

The primary force that extends the device outward as the circuit breaker trips is the action of the two sets of retaining blocks. The flower is retracted primarily through the action of the top of the base ring opposing the post.

It should be noted that alternate design would include a post of constant diameter to the cap with only the two sets of retaining blocks for extension and retraction. This alternate design was discounted by the inventor because the retraction mode places greater forces on the ring than the inventor believes the retaining blocks could support in the long-term. For this reason, extension support is provided by the action of the retaining blocks and the spring-like quality of the petals and retraction support is provided by the top of the ring contacting with the larger diameter post.

Installation

The ring and petal arrangement simply slides onto the post prior to the post being inserted into the main circuit breaker housing and is locked into placed longitudinally and radially by the grooves and retaining block arrangement. The circuit breaker post and flower device may then be assembled with the remainder of the circuit breaker components and housing using normal manufacturing procedures. If the ring must be removed prior to installation of the post, the ring may be expanded at the gap and lifted outward and over the retaining blocks.

The majority of the base ring remains below and inside the housing after installation to aid with structural stability of the design and prevent inadvertent removal. Only a small portion of the base ring and the petals are apparent when the circuit breaker is tripped i.e., open. The advantage to the circuit breaker flower design is the simplicity of construction, installation, operation, and identification.

Modifications

It is assumed that all dimensions are approximate so as not to limit modifications to said circuit breaker to allow for varying space, structural, or electrical requirements. Furthermore, the dimensions illustrate a typical push-pull type circuit breaker arrangement. Dimensions may be altered to allow for varying designs. For example, the extended portion of the circuit breaker post may be lengthened to allow for longer, more visible petals.

The angle of petal extension may vary from 0 to 90 degrees, but it is envisioned that 45 to 60 degrees will be most practical due to visibility and material requirements.

The number of petals may also vary. Once again however, due to visibility and material requirements, a 2 to 4 petal design is viewed by the inventor as most practical. Specifically, the 3-petal configuration allows for viewing from all angles, wider petals, and an overall stronger design. Additionally, the loss of one "petal" with a 3-petal design would not adversely affect the operation or purpose of the device.

The material used for construction of the circuit breaker flower should possess all the characteristics listed in the claims section of this paper. It is envisioned the material would be similar to Dupont Surlyn™ 8140/8150 or stainless spring steel.

What I claim as my invention is:

1. An aviation push-pull type circuit breaker that, when tripped, extends clearly visible petals outward from a center post, thus forming a flower said circuit breaker comprising:

a housing, the center post that extends when said circuit breaker is tripped, a ring consisting of a base and extensions, herein named petals, that slide onto a typical circuit breaker post via two guide slots and locks into place with two retaining blocks in the slots, said ring is comprised of a material that is durable with good memory i.e., spring-like, has high abrasion and corrosion resistance, and is easily visible e.g., white or flourescent, said ring incorporates rounded edges on all contacting surfaces between the flower and the circuit breaker post to reduce wear and increase ease of operation and reliability, a small gap in the base of the ring allowing for expansion over said retaining blocks wherein the flower petals line up and mate with grooves in the post in a key-like fashion with the petals manufactured in a normally-open position, actuation or tripping of said circuit breaker drives the post outward from the housing and due to retaining blocks, the flower petals extend to the normally open or wide position, the post is retracted manually and as a result of an interlock between the ring and the post, the petals also retract into the housing.

* * * * *